US006020864A

United States Patent [19]

Bancal

[11] Patent Number: 6,020,864

[45] Date of Patent: Feb. 1, 2000

[54] ADDRESSING DEVICE FOR MICROTIP FLAT DISPLAY SCREENS

[75] Inventor: Bernard Bancal, Luynes, France

[73] Assignee: Pixtech S.A., Rousset, France

[21] Appl. No.: 08/602,084

[22] Filed: Feb. 15, 1996

[30] Foreign Application Priority Data

Feb. 17, 1995 [FR] France ..... 95 02066

[51] Int. Cl.[7] ..... G09G 3/22

[52] U.S. Cl. ..... 345/74; 345/76; 345/208; 315/169.3

[58] Field of Search ..... 345/74–79, 204, 345/212, 208; 315/169.3

[56] References Cited

U.S. PATENT DOCUMENTS 4,443,741 4/1984 Tanaka et al. ..... 345/78
4,837,566 6/1989 Channing et al. ..... 345/76
5,008,657 4/1991 Hanson et al. ..... 345/74
5,138,308 8/1992 Clerc et al. ..... 345/75
5,654,729 8/1997 Garcia ..... 345/74

*Primary Examiner*—Richard A. Hjerpe
*Assistant Examiner*—Kent Chang
*Attorney, Agent, or Firm*—Plevy & Associates

[57] ABSTRACT

A device for controlling an electrode of a flat display screen includes a first electrode constituting a microtip cathode, a second electrode constituting an anode provided with phosphor elements and a gate that is arranged in rows. At least one of the electrodes is arranged in columns. The device includes circuitry for individually addressing each column and for interrupting the biasing of a column as soon as its charge reaches a threshold voltage corresponding to a desired luminescence value.

10 Claims, 6 Drawing Sheets

ADDRESSING DEVICE FOR MICROTIP FLAT DISPLAY SCREENS

BACKGROUND OF THE INVENTION

1. Field of the Invention

The present invention relates to a flat display screen. It more particularly relates to the control, or addressing, of an electrode of a microtip screen.

2. Discussion of the Related Art

FIG. 1 represents the functional structure of a conventional microtip flat display screen.

Such microtip screens comprise a cathode 1 including microtips 2 and a gate 3 with holes 4 corresponding to the positions of the microtips 2. The cathode 1 is disposed so as to face a cathodoluminescent anode 5 formed on a glass substrate 6 that constitutes the screen surface.

The operation and the detailed structure of such microtip screens are described in U.S. Pat. No. 4,940,916 assigned to Commissariat à l'Energie Atomique.

Conventionally, the cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside the meshes defined by the cathode conductors. FIG. 1 partially represents the inside of a mesh, without the cathode conductors. The cathode 1 is associated with the gate 3 which is arranged in rows. An insulating layer (not shown) is interposed between the cathode conductors and the gate 3. The intersection of a row of the gate 3 with a column of the cathode 1 defines a pixel.

This device uses the electric field generated between the cathode 1 and the gate 3 so that electrons are transferred from microtips 2 toward phosphor elements 7 of anode 5. In the case of a color screen, the anode 5 is provided with alternate strips of phosphor elements 7, each corresponding to a color (Blue, Red, Green). The strips are separated one from the other by an insulating material 8. The phosphor elements 7 are deposited onto electrodes 9, which are constituted by corresponding strips of a transparent conductive layer such as indium and tin oxide (ITO). The strips are disposed parallel to the cathode columns, a group of three strips (one for each color) facing a cathode column. Thus the width of a group of strips of the anode 5 corresponds to the width of a pixel. The groups of blue, red and green strips are alternatively biased with respect to cathode 1 so that the electrons extracted from the microtips 2 of one pixel of the cathode/gate are alternatively directed toward the facing phosphor elements 7 of each color and cross the vacuum space 12.

FIG. 2 is a schematic perspective exploded view illustrating a conventional exemplary addressing mode of a microtip screen.

For the sake of clarity, the meshes of the cathode columns K are not represented. Furthermore, the cathode 1 is represented away from the gate 3 whereas, in practice, the extremities of the microtips 2 are flush with the holes 4 formed in gate 3. In addition, only nine microtips 2 for a pixel are represented. In practice, each pixel includes several thousands of microtips, and the gate 3 includes one hole 4 around each microtip 2.

An image is displayed during an image period (for example 20 ms at a 50-Hz frequency) by adequately biasing anode 5, cathode 1 and gate 3 through a control circuitry (not shown).

The strips R, G and B of the anode phosphor elements are sequentially biased by group of strips of a same color for a frame period (for example 6.6 ms) corresponding to one third of the image period decreased by the necessary switching times. The display is performed line after line by sequentially biasing the rows L of gate 3 during a "line period" during which each column K of the cathode is raised to a potential that depends upon the brightness of the pixel to be displayed along the current row (for example $L_j$) in the selected color. The biasing of columns K of cathode 1 changes at each new row of the line scan. A "line period" (for example 10 ms) corresponds to the duration of one frame divided by the number of rows L of gate 3.

FIG. 2 illustrates the path of the electrons extracted from the microtips of columns $K_{i-1}$, $K_i$ and $K_{i+1}$ raised at potentials depending upon the desired brightness in the green color, for pixels $P_{(i-1,j)}$, $P_{(i,j)}$ and $P_{(i+1,j)}$ during a "line period" during which the row $L_j$ is biased. The surfaces of pixels P are represented in dot and dashes lines.

FIG. 3 is an equivalent simplified electric diagram of a microtip screen such as the one represented in FIG. 2. The resistive layer 11 is symbolically represented by an access resistor $R_K$ to each microtip 2. Each cathode column K and each gate row L is individually connected to the control electronic circuitry (not shown).

On the anode, each group of strips of phosphor elements 7 of a same color is connected to a biasing terminal, $A_R$, $A_G$ or $A_B$ of the control circuitry, respectively. Each strip R, G or B electrically behaves like a capacitive load having an access resistance $R_A$.

The groups of strips of phosphor elements 7 are thus sequentially raised to a potential that attracts the electrons emitted by the microtips 2. This potential is selected by the user and particularly depends upon the distance which separates the cathode/gate from the anode and ranges, for example, from 300 to 400 volts. The rows L of gate 3 are sequentially biased during a frame period. A determined row (for example $L_j$) is biased (for example at 80 volts) whereas the other rows are at a zero potential during the "line period" of the current row. The columns K of the cathode, whose potentials $v_{Ki}$ represent at each line the brightness of the pixel defined by the intersection of the columns Ki with a row Lj in the considered color (for example red), are raised to respective potentials varying between a maximum emission potential and a non-emission potential (for example 0 and 30 volts, respectively). The selection of the values of the biasing potentials depends upon the characteristics of the phosphor elements 7 and of microtips 2. Usually, below a 50-volt potential difference between the cathode 1 and the gate 3, no electron emission occurs and the maximum emission corresponds to a 80-volt potential difference.

A drawback of conventional screens is that the technologic variations, due to the fabrication of the microtips, cause the microtips of the screen to have different emitting powers. In other words, for a given potential $V_K$ representing a desired luminescence, brightness variations of the pixels occur.

A further drawback lies in that the electrons emitted by the microtips of a specific cathode column K tend to excite the strips of phosphor elements of the same colors facing two adjacent columns K. Indeed, although two strips of a same color are separated by two strips of a different color, the distance (approximately 0.2 mm) between the phosphor elements 7 and the microtips 2 leads electrons to deviate towards the nearest strips of the same color.

This illumination of adjacent pixels is illustrated in FIG. 3 for a red frame period during which all the strips $R_i$ of the anode are addressed. The electrons emitted by some microtips of the cathode column $K_i$ tend to be attracted by columns $R_i$, $R_{i+1}$ of the anode. This spurious bombardment is illustrated in dotted lines in FIG. 3.

Such a phenomenon is increased when the groups of strips of phosphor elements are misaligned with respect to the cathode columns K, which may occur when assembling the display.

SUMMARY OF THE INVENTION

An object of the present invention is to avoid the above drawbacks by providing a device for controlling an electrode of a flat display screen which ensures uniform brightness of the pixels of the screen in conformity with a desired luminescence.

For this purpose, the present invention achieves the control, or addressing, of an electrode of a flat display screen on the basis of a measurement of the charges of the columns of this electrode.

To achieve this object, the present invention provides a device for controlling an electrode of a flat display screen which includes a first electrode constituting a microtip cathode, a second electrode constituting an anode provided with phosphor elements and a gate arranged in rows, at least one of the electrodes being arranged in columns and the device including means for individually addressing each column and for interrupting the biasing of a column as soon as its charge reaches a threshold corresponding to a desired luminescence.

According to an embodiment of the invention, the above means are constituted, for each column, by a control cell including a unit for switching the column voltage between a positive supply potential and a negative supply potential, and a unit for detecting the charge of this column.

According to an embodiment of the invention, the anode comprises at least two groups of alternated strips of phosphor elements arranged in columns, and the cathode is a plane of microtips covering the whole surface of the screen.

According to an embodiment of the invention, each switching unit includes two switches connected in series between the negative supply potential and, through a sensor of the detection unit with which it is associated, the positive supply potential, and a comparator receiving a luminescence control voltage and a voltage provided by the detection unit and indicating the amount of charges received by the column, the switches constituting a biasing stage of the column controlled by the comparator whose output controls a first switch through an inverter and directly controls a second switch.

According to an embodiment of the invention, each detection unit includes a first operational amplifier having a non-inverting input which receives the voltage across a detection resistor constituting the sensor, an inverting input which receives the voltage across a load resistor and an output which is connected to the gate of a first N-channel MOS transistor disposed between the load resistor and a storing capacitor, the voltage across the capacitor constituting the voltage indicating the charge received by the column.

According to an embodiment of the invention, each control cell further includes means for discharging the capacitor before each new row of the gate is addressed.

According to an embodiment of the invention, the first switch comprises an N-channel power MOS transistor having its source connected to the negative supply potential and its drain connected both to a connection terminal of the column and to the drain of a second P-channel power MOS transistor, which constitutes the second switch and has its source connected to the positive supply voltage through the sensor.

According to an embodiment of the invention, the comparator is formed by a second operational amplifier whose inverting input receives the voltage indicating the amount of charges that are received, whose non-inverting input receives the reference voltage and whose output is provided to the gates of the power transistors of the biasing stage.

According to an embodiment of the invention, the output of the comparator is connected to the gate of the first transistor of the biasing stage through a delay element and a voltage translating device and is directly connected to the gate of the second transistor of the biasing stage, the positive supply voltage being the ground.

According to an embodiment of the invention, the reference voltage is provided by a digital-to-analog converter which receives at its input a luminescence reference in digital form.

The foregoing and other objects, features, aspects and advantages of the invention will become apparent from the following detailed description of the present invention when taken in conjunction with the accompanying drawings.

BRIEF DESCRIPTION OF DRAWINGS

For the sake of clarity, the same elements are referenced in the various figures with the same reference characters.

DETAILED DESCRIPTION

The device according to the invention uses an individual measurement of the charges of each column of the electrode with which the device is associated.

Figure 1:
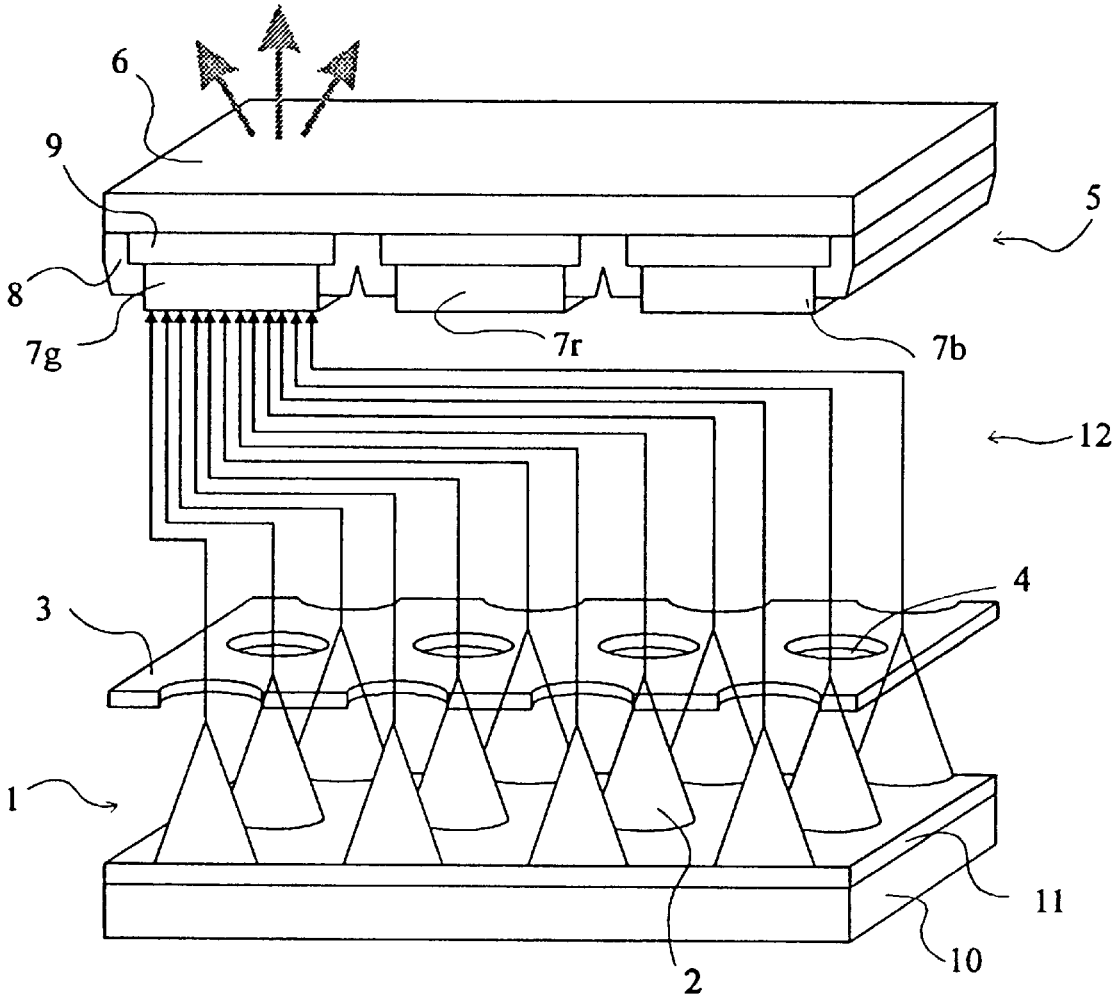
Fig 1 (PRIOR ART)
FIGS. 1–3, above described, illustrate the state of the art and the problem encountered.
Figure 2:
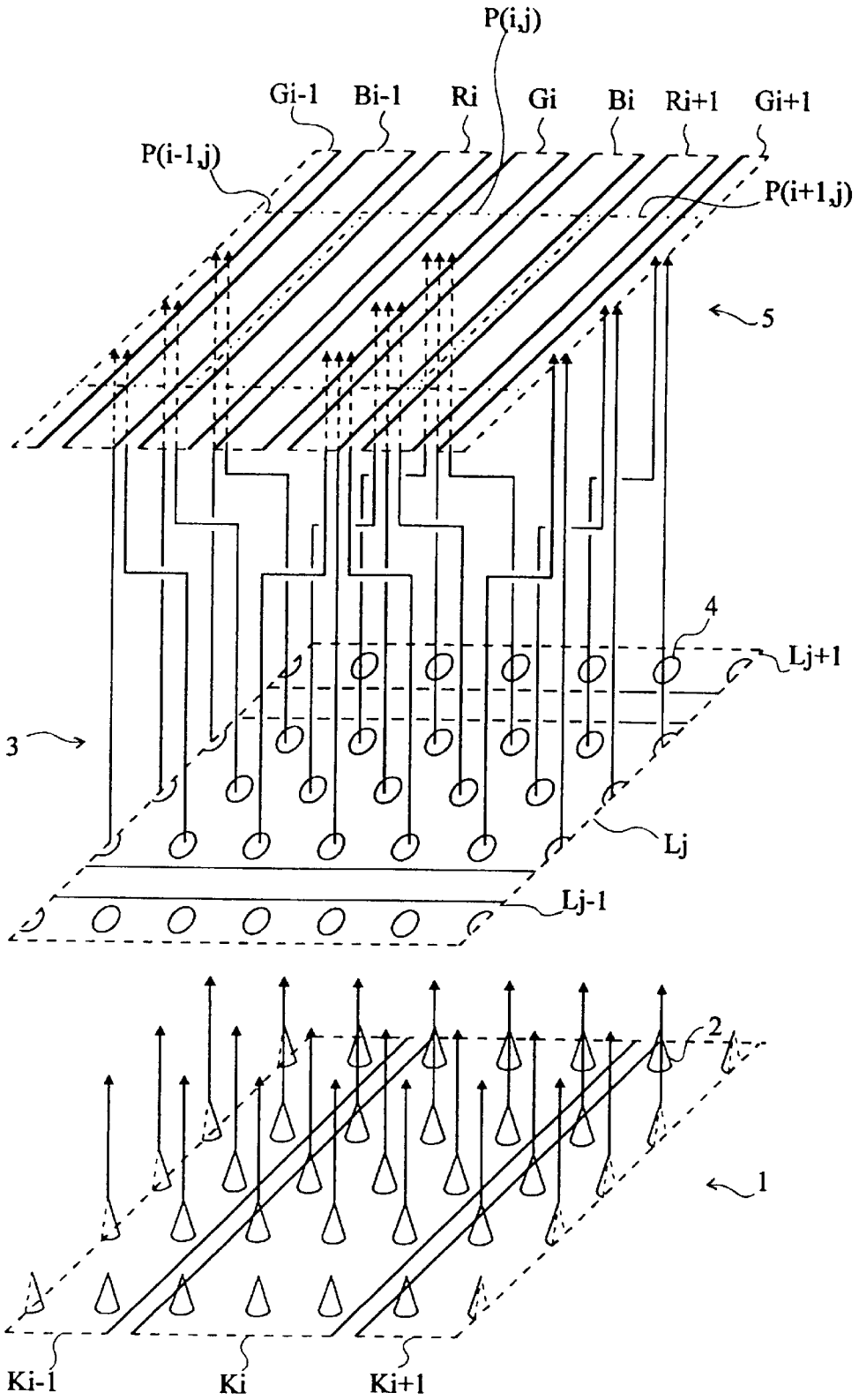
Fig 2 (PRIOR ART)
Figure 3:
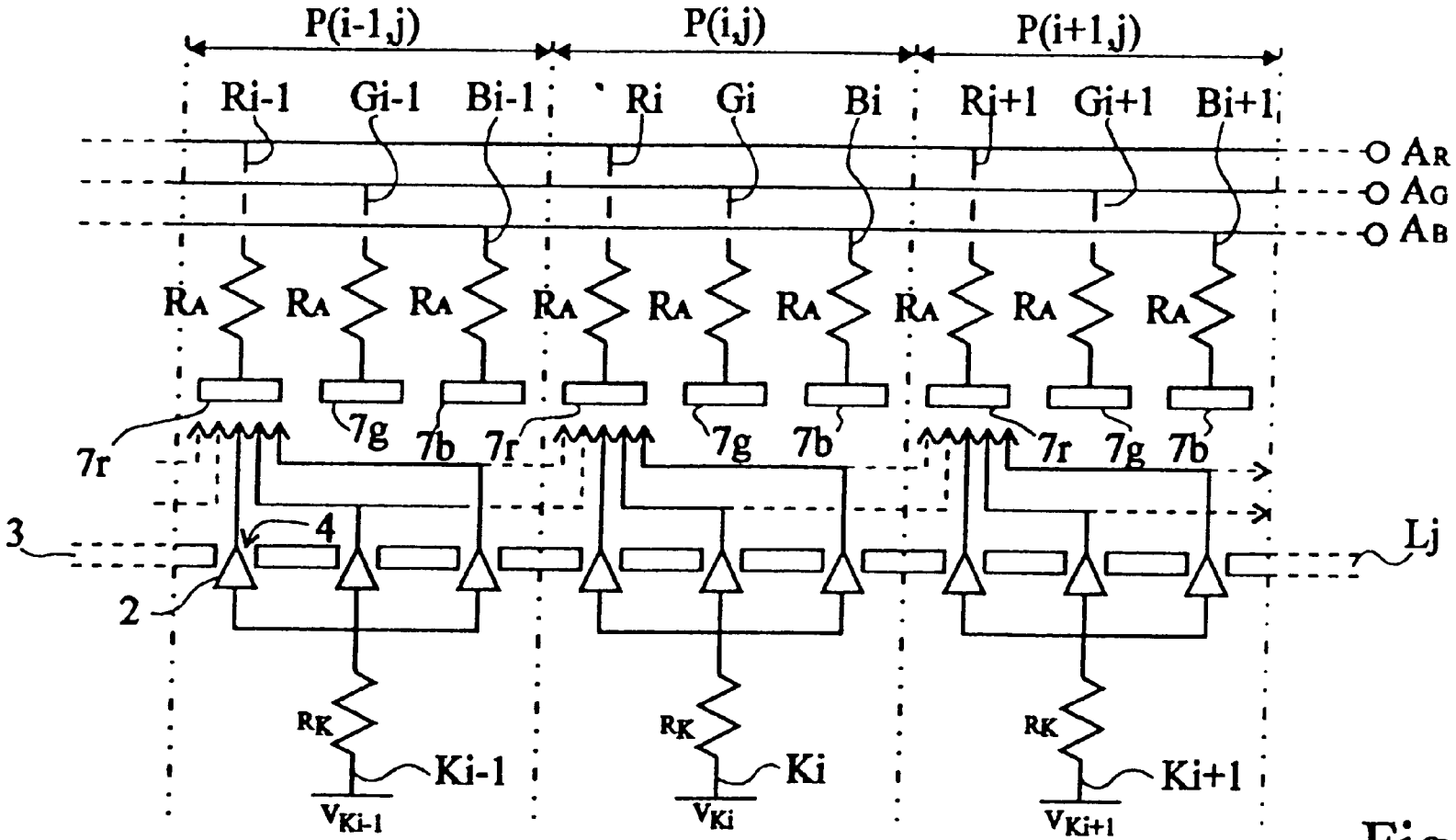
Figure 4:
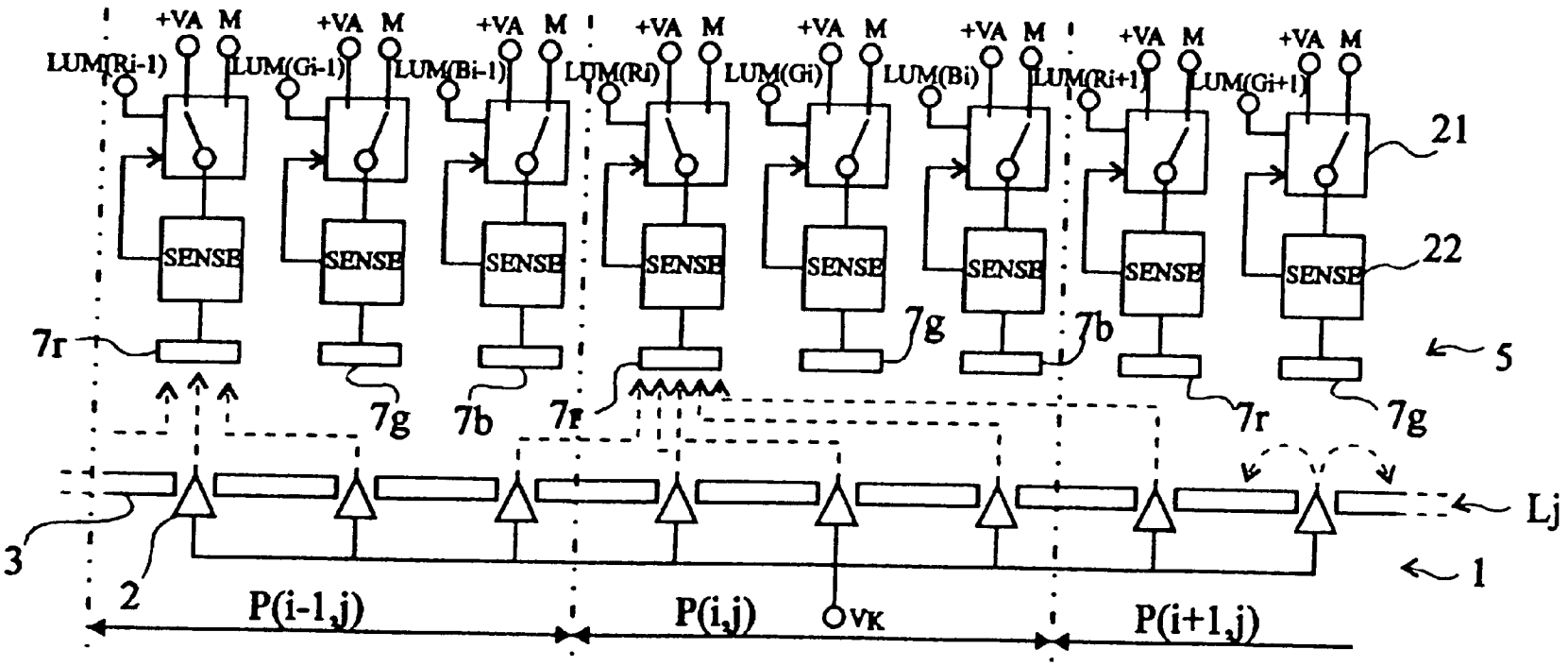
FIG. 4 represents an embodiment of a device for controlling a flat display screen according to the invention.

According to a preferred embodiment, the device is associated with the strips, or columns, of the anode. Then the amount of charges received by each column of phosphor elements bombarded by the cathode microtips is measured at each "line period". As soon as this amount corresponds to the amount required to obtain the desired brightness of the pixel in the considered color, the column biasing is switched-off. FIG. 4 illustrates such an embodiment.

According to the invention, each strip of phosphor elements 7 of the anode is individually controlled. In other words, the columns R, G, B of the anode are individually addressed by a screen control circuitry to which the device according to the invention is integrated.

Each column is associated with a control cell which includes a switching unit 21 and a unit 22 (SENSE) for counting the charges received by the phosphor elements 7 of the column. The role of unit 21 is to switch the column biasing between a positive supply voltage $+V_A$ and a negative supply voltage, here ground M. The difference in potential between the positive and negative voltages represents the addressing voltage of columns R, G, B of phosphor elements 7, for example approximately 300 to 400 volts. Switching is carried out for a desired luminescence value LUM of the pixel in the color of the column and is servocontroled by the amount of charges received by the column which is detected by means of unit 22.

Addressing is still achieved, frame after frame, by simultaneously addressing all the columns (for example the red ones) of a same color during a frame period, for example approximately 6.6 ms for a 50-Hz image frequency. The gate 3 is still sequentially addressed by row L through a line scanning. In contrast, the cathode no longer need to be addressed by columns since the anode control plays this role. During the frame period of a color (for example red), the luminescence desired values LUM($R_{i-1}$), LUM($R_i$), LUM ($R_{i+1}$), and so on, of the columns of this color are actually individualized whereas the luminescence values LUM($G_{i-1}$), LUM($B_{i-1}$), LUM($G_i$), LUM($B_i$), LUM($G_{i+1}$), and so on, of all the columns of the two other colors are null.

The invention thus enables, according to this embodiment, a simplification of the cathode structure by eliminating the mesh and column arrangement of the cathode conductors. The cathode 1 is, according to the invention, formed by a plane of microtips 2 covering the whole surface of the screen and biased at a fixed value $V_K$. Voltage $V_K$ preferably corresponds to the potential generating a maximum emission of the microtips 2. For example, if the biasing potential $V_L$ of rows L of gate 3 is 80 volts, the cathode 1 is grounded ($V_K$=0 volt).

Columns R, G, B, respectively, of a same color simultaneously begin to be addressed each time a row L of the gate begins to be addressed. The columns individually stop to be addressed through the device according to the invention. Addressing is ended, within the duration of each "line period", when the amount of charges received by a specific column corresponds to the desired luminescence for the pixel defined by the intersection of this column and the row of gates in the specific frame. Thus, as soon as a column has received its charge amount, unit 21 stops addressing this column which is no longer bombarded.

An advantage of the invention is that, for a same desired luminescence value, the brightness of the pixels is regular over the whole surface of the screen. Indeed, the brightness no longer depends upon the emission ability of the microtips of each pixel.

A further advantage of the embodiment represented in FIG. 4 is that it simplifies the positioning of the plates supporting the anode and the cathode/gate, respectively, when assembling the screen. Indeed, the columns of the anode no longer need to be aligned with the columns of the cathode, which is constituted in this case by a plane of microtips covering the whole surface of the screen.

A still further advantage of this embodiment is that, if some microtips of the cathode fail to operate, even over an area having the size of a screen pixel, the brightness of the considered pixel is not impaired. Effectively, assuming that the column facing this pixel is not sufficiently charged, its excitation is continued by the microtips of the adjacent pixels, as soon as an adjacent column of a same color is grounded again after being suitably charged.

This phenomenon is illustrated in FIG. 4 where it is assumed that a red frame period occurs and where the position of the switches of blocks 21 indicates that column $R_{i+1}$ of the pixel $P_{(i+1,j)}$ has been sufficiently charged. In this case, as indicated by the dotted lines illustrating the path of the electrons emitted by the microtips 2, the column $R_i$ of pixel $P_{(i+1,j)}$ is bombarded by some microtips which face pixel $P_{(i+1,j)}$.

When the electrons emitted by some microtips (for example those facing column $G_{i+1}$ of the pixel $P_{(i+1,j)}$ of the cathode can no longer be attracted by anode 5 because they are too far away from a biased column, these electrons are collected by gate 3.

Figure 5:
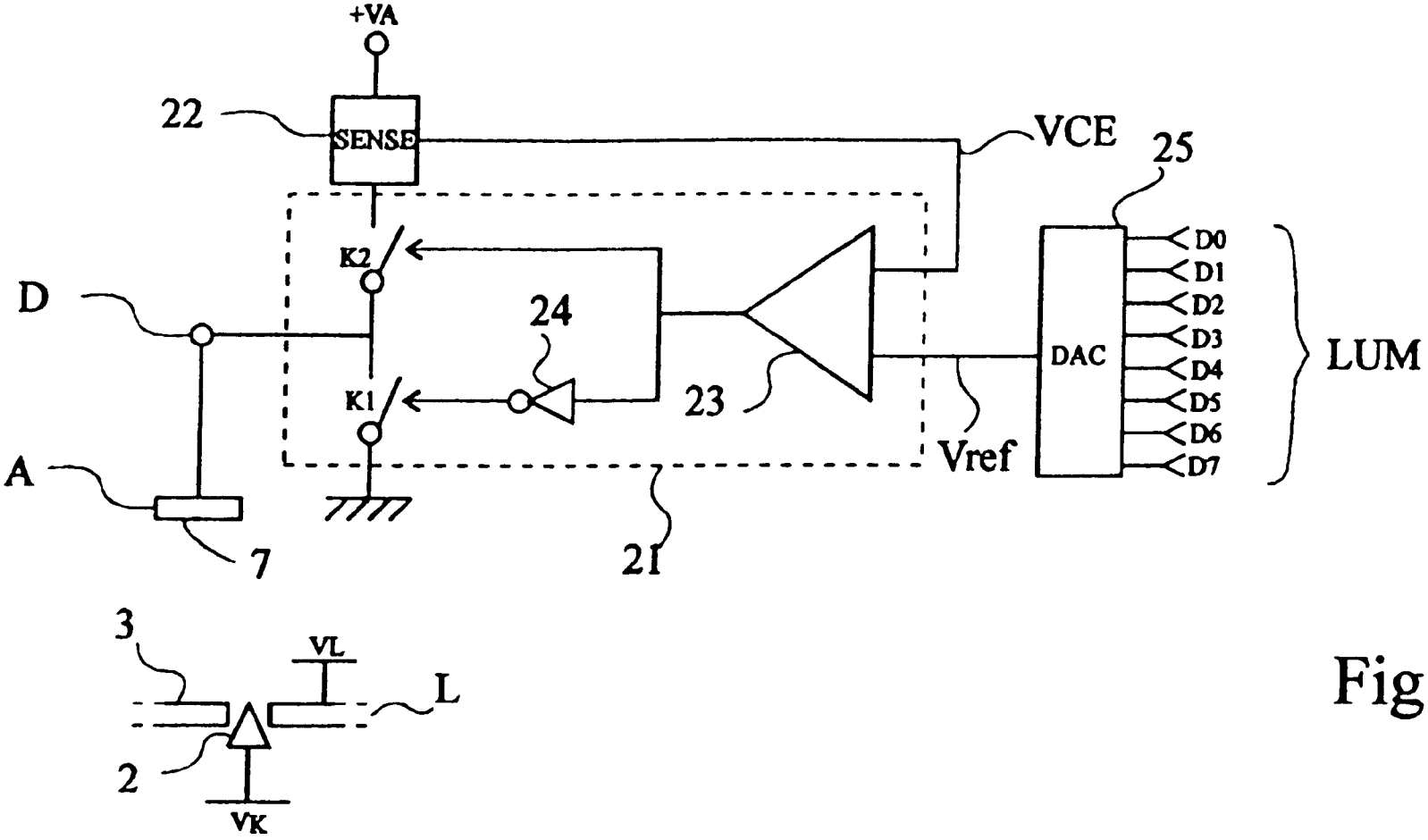
FIG. 5 represents an embodiment of a control cell constituting the device represented in FIG. 4.

FIG. 5 represents an embodiment of a control cell constituting the device represented in FIG. 4.

The switching unit 21 comprises two switches K1 and K2 connected in series between ground and a sensor of the detection unit 22. Switches K1 and K2 constitute a biasing stage of the column, referenced here as A, of phosphor elements 7 with which the cell is associated. The sensor of the detection unit 22 generates a negligible voltage drop so that it can be considered that switches K1 and K2 are connected in series between ground and potential $+V_A$. The column A is electrically connected to a terminal D corresponding to the junction of the combined switches K1 and K2.

The unit 21 also includes a comparator 23 for enabling the switching of switches K1 and K2. A first input of comparator 23 receives a voltage $V_{CE}$ indicating the amount of charges received by the column A. This voltage is transmitted by the unit 22 from the current drawn by column A from the power supply. A second input of comparator 23 receives a reference voltage Vref corresponding to the desired luminescence value LUM of the pixel in the color of the column A. The output of comparator 23 is transmitted, through an inverter 24, to the control input of the first switch K1 and is directly transmitted to the control input of the second switch K2.

When voltage $V_{CE}$ is lower than the voltage Vref, the switch K2 is turned on and switch K1 is turned off. The column A is then addressed by being raised to voltage $+V_A$. As soon as voltage $V_{CE}$ is equal to Vref, which means that column A has received the amount of charges corresponding to its luminescence reference, the output of comparator 23 inverses the positions of switches K1 and K2, which causes the biasing of the column to be cut off.

Voltage Vref is provided by a digital-to-analog converter (DAC) 25 for supplying a voltage Vref corresponding to the desired luminescence value LUM for the pixel in the considered color. The DAC 25 receives from the control circuitry (not shown) digital signals, for example 8-bit signals D0–D7, whose values correspond to the desired luminescence value LUM. If the control circuitry directly provides a luminescence value in the form of an analog signal, such a converter is no longer necessary.

According to an alternative which more particularly relates to the cases where the luminescence references LUM are encoded on a small number of bits (for example 3), a small number of analog-to-digital converters can be used to provide the reference voltages Vref to all the columns and are associated with elements for storing these voltages (one element for each anode column).

Figure 6:
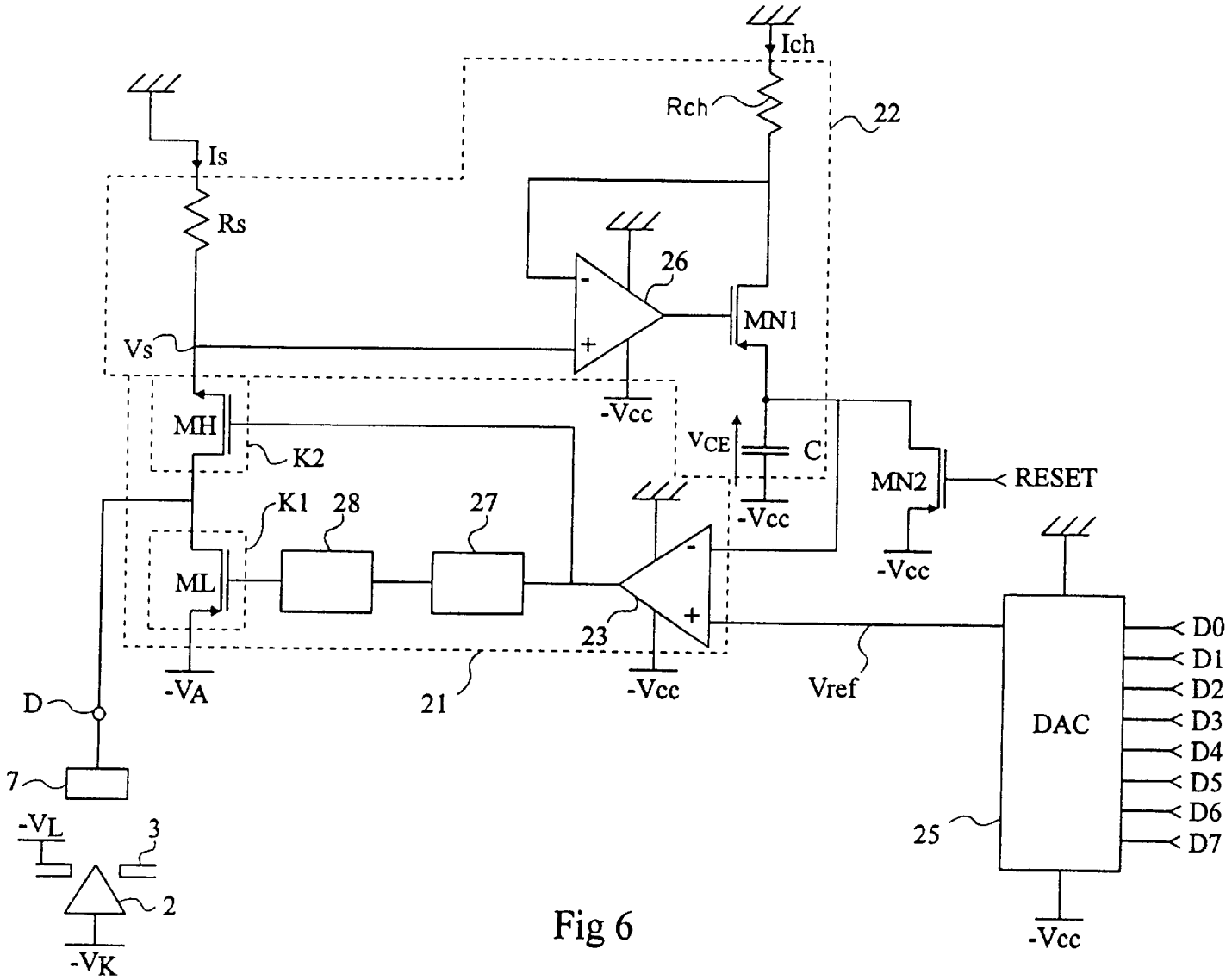
FIG. 6 represents the electric diagram of an embodiment of a control cell represented in FIG. 5.

FIG. 6 is an electric diagram of a control cell illustrating an embodiment of switches K1 and K2 and of the detection unit 22.

According to this embodiment, the positive supply voltage is constituted by ground M and the negative supply voltage is constituted by a potential $-V_A$. Selecting the ground as the positive supply voltage enables, as will be described hereinafter, to obtain a steady and regular reference and to simplify the biasing of all the cell components which are used to measure the amount of charges received by column A.

Potential $-V_A$ is for example −400 volts, potential $-V_L$ for the biasing of rows L of gate 3 is for example −320 volts and potential $-V_K$ of cathode 1 is for example −400 volts.

The detection unit 22 includes a detection resistor Rs connected between ground and switch K2. The role of resistor Rs, which forms the sensor of the detection unit, is to measure the current Is drawn by column A.

The voltage across resistor Rs is provided to the non-inverting input of a first operational amplifier 26. The positive biasing potential of amplifier 26 corresponds to the positive supply potential (ground) and its negative biasing potential is a potential −Vcc which depends upon the voltage operating range of amplifier 26, for example approximately 15 volts.

The inverting input of amplifier 26 is connected to a first terminal of a load resistor Rch whose second terminal is grounded. The first terminal of resistor Rch is also connected to the drain of a first N-channel MOS transistor MN1. The source of transistor MN1 is connected to the negative potential −Vcc through a storing capacitor C. The gate of transistor MN1 is connected to the output of amplifier 26.

The role of amplifier 26 is to duplicate the voltage Vs, across resistor Rch. Thus, the current Ich in Rch is proportional to the current in Rs. Ich=Vs/Rch=Rch*Is/Rs. If resistors Rs and Rch have the same value, this value should be high enough (for example 100 kΩ) to prevent current Ich from reaching too high values. Selecting high value resistors does not impair the anode addressing. In fact, even though the voltage drop across resistor Rs reaches approximately 10 volts, this voltage drop is negligible compared with an addressing voltage of 300 to 400 volts.

When column A is addressed, i.e., when it is connected to ground and when the column draws a current Is, the capacitor C is charged by current Ich. Voltage $V_{CE}$ across capacitor C is then proportional to the charges received by the column A. Such a charge measurement is particularly adapted to the phosphor elements whose light emission depends upon the charge and not upon the voltage.

Selecting ground as a positive supply and biasing potential avoids the provision of a high negative biasing voltage or the use of a voltage translating device at the non-inverting input of amplifier 26. In addition, this avoids possible variations of the supply and biasing voltages to affect the charge detection.

Switches K1 and K2 that form the biasing stage of column A are formed by two power MOS transistors. The biasing stage is then formed by a N-channel, ML, and a P-channel, MH, power MOS transistor. The source of the first transistor ML is connected to the negative supply potential $-V_A$ and its drain is connected to the connection terminal D of column A. Terminal D is also connected to the drain of the second transistor MH having its source connected to ground through the detection resistor Rs.

Column A is addressed by a suitable control of the gates of transistors MH and ML. The gates of transistors MH and ML are controlled through the comparator 23 formed, for example, by a second operational amplifier. Comparator 23 receives the voltage Vref provided by the DAC 25 and the voltage $V_{CE}$ across capacitor C, respectively. In other words, the inverting input of the operational amplifier 23 is connected to the drain of transistor MN1, its non-inverting input receives voltage Vref and its output controls the gates of transistors MH and ML. The comparator 23 and the DAC 25 are, like the amplifier 26, biased between ground and −Vcc. Thus, as soon as voltage $V_{CE}$ reaches Vref, indicating that the column A has received an amount of charges corresponding to the desired luminescence value LUM for the current pixel, the voltage at the output of comparator 23 becomes zero and interrupts addressing of column A.

To avoid a simultaneous switching of transistors MH and ML, the output of comparator 23 is connected to the gate of transistor ML, through a delay element 27 and a voltage translating device 28 whereas the output is directly connected to the gate of transistor MH. The delay element 27 delays the control of transistor ML with respect to the control of transistor MH, thus preventing simultaneous switching. The voltage translating device 28 brings the low-voltage output level of comparator 23 to such a level that transistor ML switches, i.e., to a voltage respectively lower than voltage $-V_A$ increased by the threshold voltage Vgs of transistor ML or higher than voltage $-V_A$ increased by voltage Vgs.

At the end of each "line period", capacitor C is discharged through a second N-channel MOS transistor MN2. The source of transistor MN2 is connected to voltage −Vcc, its drain is connected to the drain of transistor MN1 and its gate is controlled by a signal RESET provided by the control circuitry.

The duration of a "line period" corresponds, as above, to the frame period divided by the number of rows L of gate 3. For example, for a 288-row screen, the "line period" is approximately 25 ms. To prevent the addressed column from continuing to receive electrons once its charge threshold is reached, the discharge of the spurious capacitors existing between this column and its two adjacent columns must be very fast with respect to the "line period". Such a condition, which depends upon the drain-source resistance in the on-state, $Rds_{ON}$, of transistor ML, is complied with since the resistance $Rds_{ON}$ of a MOS power transistor is generally approximately 1 kΩ. Since the value of the spurious capacitors are generally approximately 10 pF, the discharge time is approximately 10 ns.

According to an alternative, the positive supply potential of the columns and the positive biasing potential of the operational amplifiers and of the DAC is a voltage $+V_A$. The negative biasing potential of the operational amplifiers and of the DAC must then correspond to $V_A$−Vcc so that the biasing voltage of the components is Vcc. The implementation of such an alternative imposes that the low-voltage components that are used do no require grounding of the circuit. Otherwise, these components are biased between +Vcc and ground; accordingly, an additional voltage translating device must be provided to allow the operation of the device. Here, the translating device 28 is associated with the gate of transistor MH and the additional translating device is, as above, associated with the non-inverting input of amplifier 26. Moreover, voltages $+V_A$ and +Vcc must be steady as a function of the operation conditions of the screen, or at least must vary in the same proportions to not cause erroneous charge detections.

The device according to the invention disclosed with relation to FIGS. 4–6 can be transposed to the individual control of the columns of a microtip cathode by measuring the charges emitted by the microtips of each column. In this case, the amount of charges (electrons) emitted by each microtip column is measured at each row of the line scan. As soon as this amount corresponds to the amount required to obtain the desired brightness of the current pixel, the biasing is cut off, which interrupts the emission of this column. Although such an embodiment renders the brightness independent from technologic variations due to the microtip fabrication, it does not prevent malfunction of an important area of microtips and imposes to maintain a column arrangement of the cathode. In addition, the spurious capacitances existing between the gate and the microtips are approximately 5 pF which generates, for the whole screen, a higher energy dissipation when these spurious capacitances are discharged.

As is apparent to those skilled in the art, various modifications can be made to the above disclosed preferred embodiments. More particularly, each of the described components can be replaced with one or more components having the same function.

In addition, the invention also applies to the control of a monocolor screen. In the case where the anode of such a screen is partitioned into two groups of alternated columns of a same color, it is advantageous to achieve addressing through an individual control of the anode columns. Conversely, if the anode is formed by a plane of phosphor elements covering the whole surface of the screen, addressing is achieved through an individual control of the cathode columns associated with measurement of the charges emitted by these columns.

I claim:

1. A device for controlling an electrode of a flat display screen having a first electrode constituting a cathode (1) including microtips (2), a second electrode constituting an anode (5) provided with phosphor elements (7), and a gate (3) that is arranged in rows (L), wherein at least one of said electrodes is arranged in columns (R, G, B), said device including means (21, 22) for individually addressing each column and for interrupting the biasing of a column as soon as its charge reaches a threshold voltage (Vref) corresponding to a desire luminescence value (LUM).

2. The device of claim 1, wherein said means include, for each column (R, G, B; A), a control cell including a switching unit (21) for switching the voltage of the column between a positive supply potential ($+V_A$; M) and a negative supply potential (M; $-V_A$), and a detection unit (22) for detecting the charge of said column.

3. The control device of claim 1, wherein said anode (5) of said flat display screen includes at least two groups of alternated strips of phosphor elements (7) arranged in columns (R, G, B), and wherein said cathode (1) comprises a plane of microtips (2) covering the whole surface of the screen.

4. The control device of claim 3, wherein each switching unit (21) includes two switches (K1, K2) connected in series between the negative supply potential (M; $-V_A$) and, through a sensor (Rs) of the detection unit (22) with which it is associated, the positive supply potential ($+V_A$; M), and a comparator (23) receiving a luminescence control voltage (Vref) and a voltage ($V_{CE}$) provided by said detection unit (22) and indicating the amount of charges received by said column (A), said switches (K1, K2) constituting a biasing stage of the column controlled by said comparator (23) whose output controls a first switch (K1) through an inverter (24) and directly controls a second switch (K2).

5. The control circuit of claim 4, wherein each detection unit (22) includes a first operational amplifier (26), having a non-inverting input which receives the voltage (Vs) across a detection resistor (Rs) constituting said sensor, an inverting input which receives the voltage across a load resistor (Rch) and an output which is connected to the gate of a first N-channel MOS transistor (MN1) disposed between the load resistor (Rch) and a storing capacitor (C), the voltage across the capacitor (C) constituting the voltage ($V_{CE}$) indicating the charges received by said column (A).

6. The control device of claim 5, wherein each control cell further includes means (MN2) for discharging said capacitor (C) before each new row (L) of said gate (3) is addressed.

7. The control device of claim 4, wherein said first switch (K1) is formed by an N-channel power MOS transistor (ML) having a source connected to said negative supply potential ($-V_A$; M) and a drain connected both to a connection terminal (D) of said column (A) and to the drain of a second P-channel power MOS transistor (MH), which constitutes said second switch (K2) and has a source connected to said positive supply voltage ($+V_A$; M) through said sensor (Rs).

8. The control device of claim 7, wherein said comparator (23) comprises a second operational amplifier whose inverting input receives said voltage ($V_{CE}$) indicating the amount of received charges, whose non-inverting input receives said threshold voltage (Vref) and whose output is applied to the gates of said power transistors (ML, MH) of the biasing stage (K1, K2).

9. The control device of claim 7, wherein the output of said comparator (23) is connected to the gate of said first transistor (ML) of the biasing stage (K1, K2) through a delay element (27) and a voltage translating device (28) and is directly connected to the gate of said second transistor (MH) of the biasing stage, said positive supply voltage being the ground (M).

10. The control device of claim 1, wherein said threshold voltage (Vref) is provided by a digital-to-analog converter (25) which receives a luminescence desired value (LUM) in digital form (D0–D7).

* * * * *